US006351903B1

(12) United States Patent
Tuomi

(10) Patent No.: US 6,351,903 B1
(45) Date of Patent: Mar. 5, 2002

(54) MEDICAL ALERT KEY TAG

(76) Inventor: Christine M. Tuomi, 6504 Moorman Rd., Louisville, KY (US) 40272

( * ) Notice: Subject to any disclaimer, the term of this patent is extended or adjusted under 35 U.S.C. 154(b) by 0 days.

(21) Appl. No.: 09/535,788

(22) Filed: Mar. 28, 2000

(51) Int. Cl.[7] ..... A44B 15/00

(52) U.S. Cl. ..... 40/634; 70/456 R; 362/116; 206/38.1

(58) Field of Search ..... 40/634, 330, 661.02, 40/574, 715; 70/456 R, 460; 362/116; 206/37.1, 37.4, 38.1

(56) References Cited

U.S. PATENT DOCUMENTS

| | | | | | |
|---|---|---|---|---|---|
| 1,795,291 | A | | 3/1931 | Dunn | |
| 2,865,120 | A | * | 12/1958 | Hines | 40/634 |
| 2,985,006 | A | | 5/1961 | Du Bois | |
| 4,190,975 | A | * | 3/1980 | Murphy | 40/634 |
| 4,197,665 | A | * | 4/1980 | Siiter | 40/634 |
| 4,314,467 | A | * | 2/1982 | Arvan | 70/456 R |
| 4,358,944 | A | | 11/1982 | Stoffel | |
| 4,521,981 | A | * | 6/1985 | Kasprzycki | 40/634 |
| 4,637,236 | A | | 1/1987 | Almblad | |
| 4,704,770 | A | * | 11/1987 | Minami et al. | 24/431 |
| 4,741,434 | A | * | 5/1988 | Liebman | 206/38 |
| 5,038,590 | A | | 8/1991 | Sawyer et al. | |
| 5,291,768 | A | * | 3/1994 | Rieffel et al. | 70/460 |
| 5,450,064 | A | * | 9/1995 | Williams, Jr. et al. | 340/574 |
| 5,463,539 | A | * | 10/1995 | Vandenbelt et al. | 362/189 |
| 5,467,871 | A | * | 11/1995 | DeField | 206/38.1 |
| 5,573,109 | A | * | 11/1996 | Isacson | 206/38.1 |
| 5,617,751 | A | * | 4/1997 | Song | 70/456 R |
| D409,504 | S | * | 5/1999 | Collier | D10/34 |
| 6,039,454 | A | * | 3/2000 | Hallgrimsson | 362/116 |
| 6,079,845 | A | * | 6/2000 | Kreider | 362/116 |
| 6,089,728 | A | * | 7/2000 | Weinstein | 362/116 |

* cited by examiner

*Primary Examiner*—B. Dayoan
*Assistant Examiner*—William L. Miller
(74) *Attorney, Agent, or Firm*—Joseph N. Breaux

(57) ABSTRACT

A medical alert key tag that includes a translucent paper information disk having opaque writing thereon and a light source positioned there behind such that when the light source is illuminated, the information disk is easily readable in the dark. The key tag also includes a beam focusing lens to allow the light source to also be used as a flashlight for illuminating key holes and the like.

1 Claim, 1 Drawing Sheet

MEDICAL ALERT KEY TAG

TECHNICAL FIELD

The present invention relates to medical alert devices and more particularly to a medical alert key tag that includes a tag body assembly, a translucent paper information disk, and a transparent information disk cover; the tag body assembly including an opaque molded body having a battery powered light source provided within an open topped, light source chamber formed therein that is controllable by a momentary contact on/off switch wired in controlling connection with the light source, a transparent beam directing lens installed in a lens opening formed through a sidewall of the molded body such that light from the light source travels out of the light source chamber through the beam directing lens; the translucent paper information disk being sized to completely cover the open topped light source chamber, having opaque lettering provided on one side thereof providing medical information and being constructed from a paper of a translucency such that light emitted from the light source causes the translucent paper information disk to emit light when the translucent paper information disk is positioned over the open topped light source chamber; the transparent information disk cover being snap fittable into connection with the molded body such that the translucent paper information disk is held in position over the open topped light source chamber.

BACKGROUND ART

Many individuals have medical conditions and allergies that must be immediately communicated to emergency medical personnel to allow the emergency medical personnel to provide safe and effective medical care. Although it is imperative that this information be transmitted, the person needing the medical care is often unconscious or otherwise unable to communicate with the medical personnel. It would be a benefit, therefore, to have a device that included a mechanism for providing emergency medial information. Because the device must be carried at all times to be most effective, it would be a further benefit to have a medical information device that performed a second useful function which would benefit the individual so the likelihood of carrying the device would be increased. Because emergencies, such as car wrecks, often happen in dark areas, it would be a further benefit if the medical information device could be easily read in the dark.

GENERAL SUMMARY DISCUSSION OF INVENTION

It is thus an object of the invention to provide a medical alert key tag that includes a tag body assembly, a translucent paper information disk, and a transparent information disk cover; the tag body assembly including an opaque molded body having a battery powered light source provided within an open topped, light source chamber formed therein that is controllable by a momentary contact on/off switch wired in controlling connection with the light source, a transparent beam directing lens installed in a lens opening formed through a sidewall of the molded body such that light from the light source travels out of the light source chamber through the beam directing lens; the translucent paper information disk being sized to completely cover the open topped light source chamber, having opaque lettering provided on one side thereof providing medical information and being constructed from a paper of a translucency such that light emitted from the light source causes the translucent paper information disk to emit light when the translucent paper information disk is positioned over the open topped light source chamber; the transparent information disk cover being snap fittable into connection with the molded body such that the translucent paper information disk is held in position over the open topped light source chamber.

Accordingly, a medical alert key tag is provided. The medical alert key tag includes a tag body assembly, a translucent paper information disk, and a transparent information disk cover; the tag body assembly including an opaque molded body having a battery powered light source provided within an open topped, light source chamber formed therein that is controllable by a momentary contact on/off switch wired in controlling connection with the light source, a transparent beam directing lens installed in a lens opening formed through a sidewall of the molded body such that light from the light source travels out of the light source chamber through the beam directing lens; the translucent paper information disk being sized to completely cover the open topped light source chamber, having opaque lettering provided on one side thereof providing medical information and being constructed from a paper of a translucency such that light emitted from the light source causes the translucent paper information disk to emit light when the translucent paper information disk is positioned over the open topped light source chamber; the transparent information disk cover being snap fittable into connection with the molded body such that the translucent paper information disk is held in position over the open topped light source chamber.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 2:
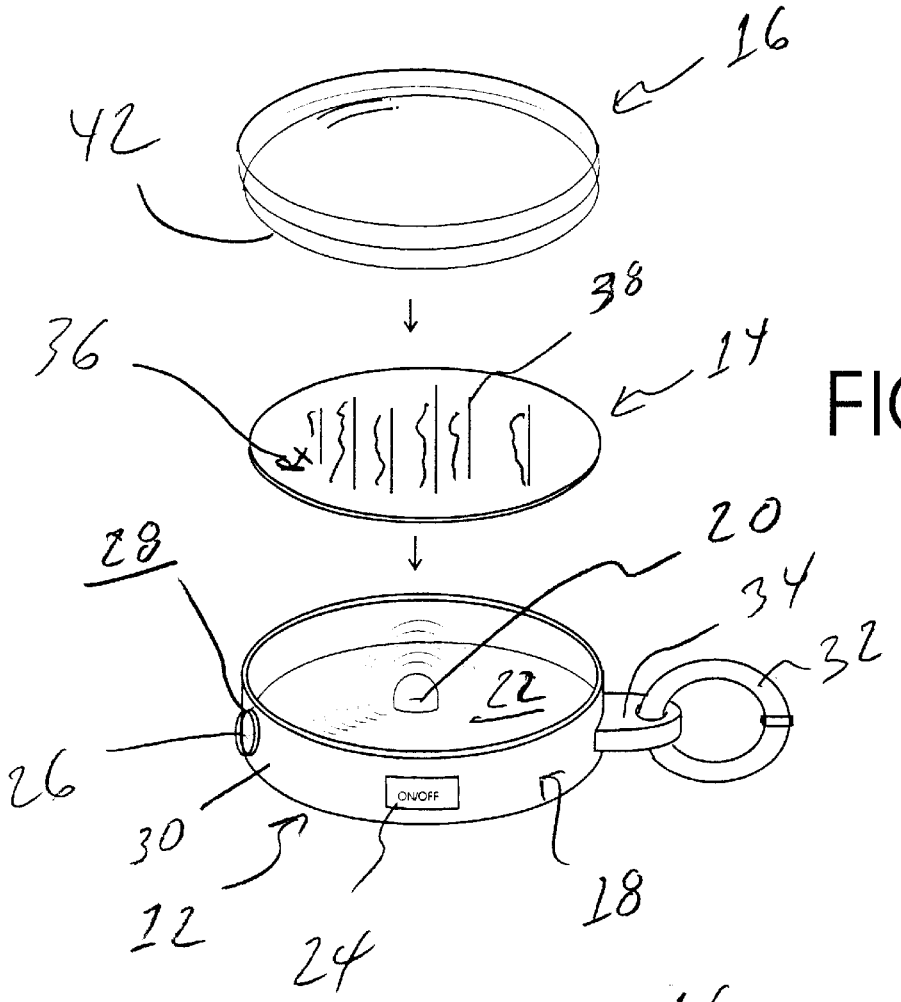
FIG. 2 is an exploded perspective view of the exemplary medical alert key tag of FIG. 1 showing the tag body assembly, the translucent paper information disk, and the transparent information disk cover; the tag body assembly including an opaque molded body having a battery powered light source provided within an open topped, light source chamber formed therein that is controllable by a momentary contact on/off switch wired in controlling connection with the light source, a transparent beam directing lens installed in a lens opening formed through a sidewall of the molded body such that light from the light source travels out of the light source chamber through the beam directing lens; the translucent paper information disk being sized to completely cover the open topped light source chamber, having opaque lettering provided on one side thereof providing medical information and being constructed from a paper of a translucency such that light emitted from the light source causes the translucent paper information disk to emit light when the translucent paper information disk is positioned over the open topped light source chamber; the transparent information disk cover being snap fittable into connection with the molded body such that the translucent paper information disk is held in position over the open topped light source chamber.
Figure 1:
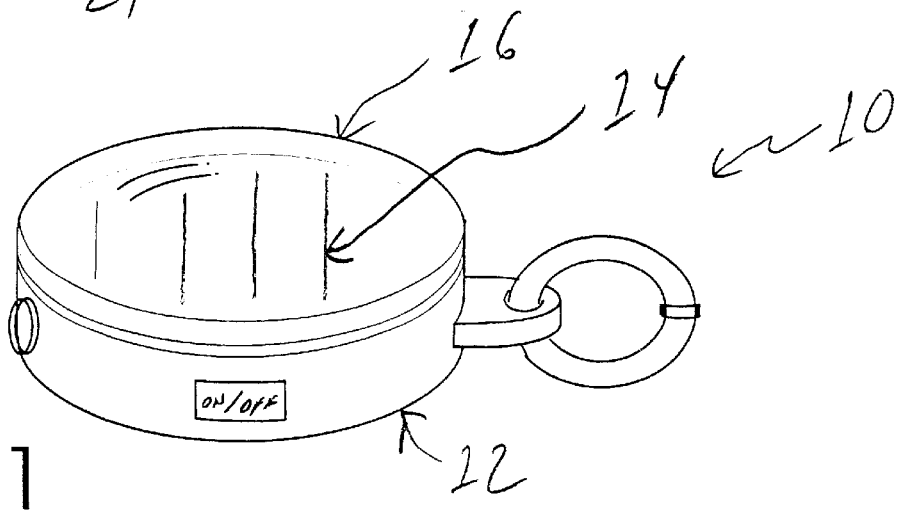
FIG. 1 is a perspective view of an exemplary embodiment of the medical alert key tag of the present invention.

FIGS. 1 and 2 show various aspects of an exemplary embodiment of the medical alert key tag of the present invention, generally designated 10. Medical alert key tag 10 includes a tag body assembly, generally designated 12; a translucent paper information disk, generally designated 14; and a transparent information disk cover, generally designated 16.

Tag body assembly 12 includes an opaque molded body, generally designated 18, having a battery powered light source 20 provided within an open topped, light source chamber 22 formed therein that is controllable by a momentary contact on/off switch 24 wired in controlling connection with light source 20; a transparent beam directing lens 26 installed in a lens opening 28 formed through a sidewall 30 of molded body 18 such that light from light source 20 travels out of light source chamber 22 through beam directing lens 26. A key connecting ring 32 is attached to a ring attachment structure 34 that is integrally molded with molded body 18.

Translucent paper information disk 14 is sized and shaped to completely cover open topped light source chamber 22. Opaque lettering 36, such as information written or typed in by a user, is provided on an outwardly facing side 38 of disk 14. Disk 14 is constructed from a caper having sufficient translucency such that light emitted from light source 20 causes translucent paper information disk 14 to emit light when translucent paper information disk 14 is positioned over open topped light source chamber 22.

Transparent information disk cover 16 is molded from transparent plastic and has a connecting ring 42 to allow it to be snap fittable into connection with molded body 18 such that translucent paper information disk 14 is held in position over open topped light source chamber 22.

It can be seen from the preceding description that a medical alert key tag has been provided.

It is noted that the embodiment of the medical alert key tag described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A medical alert key tag comprising:

a tag body assembly;

a translucent paper information disk; and a transparent information disk cover;

said tag body assembly including an opaque molded body having a battery powered light source provided within an open topped, light source chamber formed therein that is controllable by a momentary contact on/off switch wired in controlling connection with said light source, a transparent beam directing lens installed in a lens opening formed through a sidewall of said molded body such that light from said light source travels out of said light source chamber through said beam directing lens;

said translucent paper information disk being sized to completely cover said open topped light source chamber, having opaque lettering provided on one side thereof providing medical information and being constructed from a paper of a translucency such that light emitted from said light source causes said translucent paper information disk to emit light when said translucent paper information disk is positioned over said open topped light source chamber;

said transparent information disk cover being snap fiftable into connection with said molded body such that said translucent paper information disk is held in position over said open topped light source chamber.

* * * * *